US007189141B2

(12) United States Patent
Tolles

(10) Patent No.: US 7,189,141 B2
(45) **Date of Patent: *Mar. 13, 2007**

(54) POLISHING PAD WITH TRANSPARENT WINDOW HAVING REDUCED WINDOW LEAKAGE FOR A CHEMICAL MECHANICAL POLISHING APPARATUS

(75) Inventor: Robert D. Tolles, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 117 days.

This patent is subject to a terminal disclaimer.

(21) Appl. No.: 10/391,095

(22) Filed: Mar. 18, 2003

(65) Prior Publication Data

US 2003/0171070 A1 Sep. 11, 2003

Related U.S. Application Data

(63) Continuation of application No. 10/346,430, filed on Jan. 16, 2003, now Pat. No. 6,896,585, which is a continuation of application No. 09/651,345, filed on Aug. 29, 2000, now Pat. No. 6,524,164.

(60) Provisional application No. 60/153,665, filed on Sep. 14, 1999, provisional application No. 60/153,668, filed on Sep. 14, 1999.

(51) Int. Cl.
*B24B 1/00* (2006.01)

(52) U.S. Cl. ..... 451/6; 451/921; 451/285; 451/289; 451/41

(58) Field of Classification Search ..... 451/41, 451/921, 526, 528, 529, 533–539, 6, 458
See application file for complete search history.

(56) References Cited

U.S. PATENT DOCUMENTS 5,081,796 A 1/1992 Schultz
5,196,353 A 3/1993 Sandhu et al.
5,257,478 A 11/1993 Hyde et al.
5,265,378 A 11/1993 Rostoker
5,413,941 A 5/1995 Koos et al.
5,433,651 A 7/1995 Lustig et al.
5,486,129 A 1/1996 Sandhu
5,489,233 A 2/1996 Cook et al.
5,605,760 A 2/1997 Roberts
5,609,511 A 3/1997 Moriyama et al.
5,663,797 A 9/1997 Sandhu
5,672,091 A 9/1997 Takahashi et al.
5,725,420 A 3/1998 Torii
5,838,447 A 11/1998 Hiyama et al.
5,872,633 A 2/1999 Holzapfel et al.

(Continued)

FOREIGN PATENT DOCUMENTS

EP 468 897 1/1992

(Continued)

*Primary Examiner*—Jacob K. Ackun, Jr.
(74) *Attorney, Agent, or Firm*—Fish & Richardson

(57) ABSTRACT

The polishing pad for a chemical mechanical polishing apparatus and method of making the same has a polishing pad with a bottom layer, a polishing surface on a top layer and a transparent sheet of material interposed between the two layers. Slurry from the chemical mechanical polishing process is prevented from penetrating the impermeable transparent sheet to the bottom layer of the polishing pad.

17 Claims, 3 Drawing Sheets

U.S. PATENT DOCUMENTS

| | | | | |
|---|---|---|---|---|
| 5,893,796 | A | 4/1999 | Birang et al. | |
| 5,949,927 | A | 9/1999 | Tang | |
| 5,964,643 | A | 10/1999 | Birang et al. | |
| 6,045,439 | A | 4/2000 | Birang et al. | |
| 6,068,539 | A | 5/2000 | Bajaj | |
| 6,077,783 | A | 6/2000 | Allman et al. | |
| 6,089,966 | A | 7/2000 | Arai et al. | |
| 6,090,475 | A | 7/2000 | Robinson et al. | |
| 6,102,775 | A | 8/2000 | Ushio et al. | |
| 6,146,248 | A | 11/2000 | Jairath et al. | |
| 6,171,181 | B1 | 1/2001 | Roberts et al. | |
| 6,179,709 | B1 | 1/2001 | Redeker | |
| 6,190,234 | B1 | 2/2001 | Swedek et al. | |
| 6,213,845 | B1 | 4/2001 | Elledge | |
| 6,254,459 | B1 | 7/2001 | Bajaj et al. | |
| 6,280,289 | B1 | 8/2001 | Wiswesser et al. | |
| 6,280,290 | B1 | 8/2001 | Birang et al. | |
| 6,358,130 | B1 * | 3/2002 | Freeman et al. | 451/285 |
| 6,524,164 | B1 * | 2/2003 | Tolles | 451/6 |
| 6,537,133 | B1 | 3/2003 | Birang et al. | |
| 6,585,563 | B1 | 7/2003 | Redeker et al. | |
| 6,676,717 | B1 | 1/2004 | Birang et al. | |
| 6,719,818 | B1 | 4/2004 | Birang et al. | |
| 6,796,880 | B2 | 9/2004 | Redeker et al. | |
| 6,896,585 | B2 | 5/2005 | Tolles | |
| 2001/0036805 | A1 | 11/2001 | Birang et al. | |

FOREIGN PATENT DOCUMENTS

| | | | |
|---|---|---|---|
| EP | 00663265 | | 7/1995 |
| EP | 0738561 | A1 | 10/1996 |
| EP | 0881040 | A2 | 2/1998 |
| EP | 0881484 | A2 | 12/1998 |
| FR | 1075634 | | 10/1954 |
| JP | 5-309558 | | 1/1978 |
| JP | 58-4353 | | 9/1983 |
| JP | 62-211927 | | 9/1987 |
| JP | 2-222533 | | 9/1990 |
| JP | 3-234467 | | 10/1991 |
| JP | 06-039705 | | 2/1994 |
| JP | 7-052032 | | 2/1995 |
| JP | 08-264627 | | 10/1996 |
| JP | 9-36072 | | 1/1997 |
| JP | 9-117855 | | 5/1997 |
| JP | 09-277162 | | 10/1997 |
| JP | 10-034530 | | 2/1998 |
| JP | 10-058309 | | 3/1998 |
| JP | 10-094959 | | 4/1998 |
| JP | 11-291162 | | 10/1999 |
| WO | WO 93/20976 | | 10/1993 |
| WO | WO 97/06921 | | 2/1997 |
| WO | WO 01/12387 | | 2/2001 |

* cited by examiner

POLISHING PAD WITH TRANSPARENT WINDOW HAVING REDUCED WINDOW LEAKAGE FOR A CHEMICAL MECHANICAL POLISHING APPARATUS

RELATED APPLICATIONS

This application is a continuation of U.S. patent application Ser. No. 10/346,430, filed Jan. 16, 2003, U.S. Pat. No. 6,896,585, which is a continuation of U.S. patent application Ser. No. 09/651,345, filed on Aug. 29, 2000, now U.S. Pat. No. 6,524,164, which claims priority from U.S. Provisional Patent Application Ser. No. 60/153,665, filed on Sep. 14, 1999, both of which are incorporated herein by reference. This application is related to U.S. Provisional Patent Application Ser. No. 60/153,668.

TECHNICAL FIELD

This invention relates generally to semiconductor manufacture, and more particularly to a method for forming a transparent window in a polishing pad for use in chemical mechanical polishing (CMP).

BACKGROUND

In the process of fabricating modem semiconductor integrated circuits (ICs), it is necessary to form various material layers and structures over previously formed layers and structures. However, the prior formations often leave the top surface topography of an in-process wafer highly irregular, with bumps, areas of unequal elevation, troughs, trenches, and/or other surface irregularities. These irregularities cause problems when forming the next layer. For example, when printing a photolithographic pattern having small geometries over previously formed layers, a very shallow depth of focus is required. Accordingly, it becomes essential to have a flat and planar surface, otherwise, some parts of the pattern will be in focus and other parts will not. In fact, surface variations on the order of less than 1000 Å over a 25×25 mm die would be preferable. In addition, if the irregularities are not leveled at each major processing step, the surface topography of the wafer can become even more irregular, causing further problems as the layers stack up during further processing. Depending on the die type and the size of the geometries involved, the surface irregularities can lead to poor yield and device performance. Consequently, it is desirable to effect some type of planarization, or leveling, of the IC structures. In fact, most high density IC fabrication techniques make use of some method to form a planarized wafer surface at critical points in the manufacturing process.

One method for achieving semiconductor wafer planarization or topography removal is the chemical mechanical polishing (CMP) process. In general, the chemical mechanical 5 polishing (CMP) process involves holding and/or rotating the wafer against a rotating polishing platen under a controlled pressure. As shown in FIG. 1, a typical CMP apparatus 10 includes a polishing head 12 for holding the semiconductor wafer 14 against the polishing platen 16. The polishing platen 16 is covered with a pad 18. This pad 18 typically has a backing layer 20 which interfaces with the surface of the platen and a covering layer 22 10 which is used in conjunction with a chemical polishing slurry to polish the wafer 14. However, some pads have only a covering layer and no backing layer. The covering layer 22 is usually a blown polyurethane pad (e.g. Rodel IC 1000) or a sheet of polyurethane with a grooved surface (e.g. Rodel OXP3000). The pad material is wetted with the chemical polishing slurry containing both an abrasive and chemicals. One typical chemical slurry includes KOH (Potassium Hydroxide) and fumed-silica particles. The platen is usually rotated about its central axis 24. In addition, the polishing head is usually rotated about its central axis 26, and translated across the surface of the platen 16 via a translation arm 28. Although just one polishing head is shown in FIG. 1, CMP devices typically have more than one of these heads spaced circumferentially around the polishing platen.

A particular problem encountered during a CMP process is in the determination that a part has been planarized to a desired flatness or relative thickness. In general, there is a need to detect when the desired surface characteristics or planar condition has been reached. This has been accomplished in a variety of ways. Early on, it was not possible to monitor the characteristics of the wafer during the CMP process. Typically, the wafer was removed from the CMP apparatus and examined elsewhere. If the wafer did not meet the desired specifications, it had to be reloaded into the CMP apparatus and reprocessed. This was a time consuming and labor-intensive procedure. Alternatively, the examination might have revealed that an excess amount of material had been removed, rendering the part unusable. There was, therefore, a need in the art for a device which could detect when the desired surface characteristics or thickness had been achieved, in-situ, during the CMP process.

Several devices and methods have been developed for the in-situ detection of endpoints during the CMP process. For instance, devices and methods that are associated with the use of ultrasonic sound waves, and with the detection of changes in mechanical resistance, electrical impedance, or wafer surface temperature, have been employed. These devices and methods rely on determining the thickness of the wafer or a layer thereof, and establishing a process endpoint, by monitoring the change in thickness. In the case where the surface layer of the wafer is being thinned, the change in thickness is used to determine when the surface layer has the desired depth. And, in the case of planarizing a patterned wafer with an irregular surface, the endpoint is determined by monitoring the change in thickness and knowing the approximate depth of the surface irregularities. When the change in thickness equals the depth of the irregularities, the CMP process is terminated. Although these devices and methods work reasonably well for the applications for which they were intended, there is still a need for systems which provide a more accurate determination of the endpoint.

SUMMARY

The present invention provides a polishing pad for a chemical mechanical polishing apparatus. The polishing pad comprises a polishing surface, a bottom surface, and an aperture formed in the polishing surface. The aperture extends through the polishing pad from the polishing surface to the bottom surface of the pad. A transparent sheet is positioned below the polishing surface to seal the aperture from leakage of fluid from the polishing surface out the bottom surface of the polishing pad.

By positioning a transparent sheet below the polishing surface in a manner that seals the aperture from leakage of fluid, the present invention allows a laser interferometer, in or below the platen on which the pad is mounted, to be employed to detect the polishing condition of a wafer overlying the pad without significant diffraction of the laser light. The transparent sheet performs this function in a relatively inexpensive and light-weight manner.

The earlier stated needs can also be met by another embodiment of the present invention which provides a method of forming a polishing pad comprising the steps of forming an aperture in a polishing pad. This aperture extends from a polishing surface of the polishing pad to a bottom surface of the polishing pad. A transparent sheet is fixed below the polishing surface of the polishing pad in a position that seals the aperture from leakage of fluid from the polishing surface out the bottom surface of the polishing pad. In certain embodiments, the transparent sheet is positioned so that it extends across the aperture between the top surface and the bottom surface.

One of the potential advantages of positioning a transparent sheet across the aperture 30 between the top surface and the bottom surface is the provision of a barrier to fluid flow between the top surface and the bottom surface of the polishing pad. The transparent sheet acts to prevent a flow of slurry to a location that would substantially scatter the laser light.

The foregoing and other features, aspects and advantages of the present invention will become apparent from the following detailed description of the present invention when taken in conjunction with the accompanying drawings.

DETAILED DESCRIPTION

The present invention overcomes problems associated with a polishing pad having a window that is used in conjunction with a laser interferometer in a chemical mechanical polishing apparatus to detect the endpoint of a polishing process. Among the problems addressed by the present invention, leakage of chemical mechanical polish slurry from the polishing surface on the polishing pad to the hole underneath the pad is prevented. A transparent sheet interposed between the top and bottom layers acts as a shield to block a flow path of slurry from the polishing surface. By keeping the hole free of slurry, the scattering and attenuation of laser light caused by the presence of the slurry is avoided.

Figure 1:
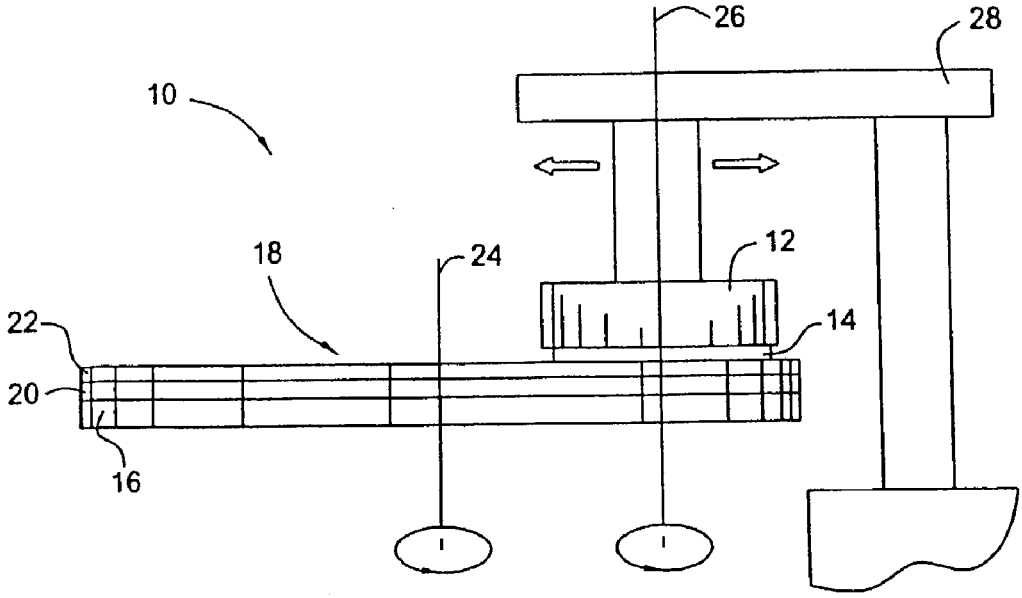
FIG. 1 (PRIOR ART)
FIG. 1 is a side view of a chemical mechanical polishing (CMP) apparatus constructed in accordance with the prior art.
Figure 2:
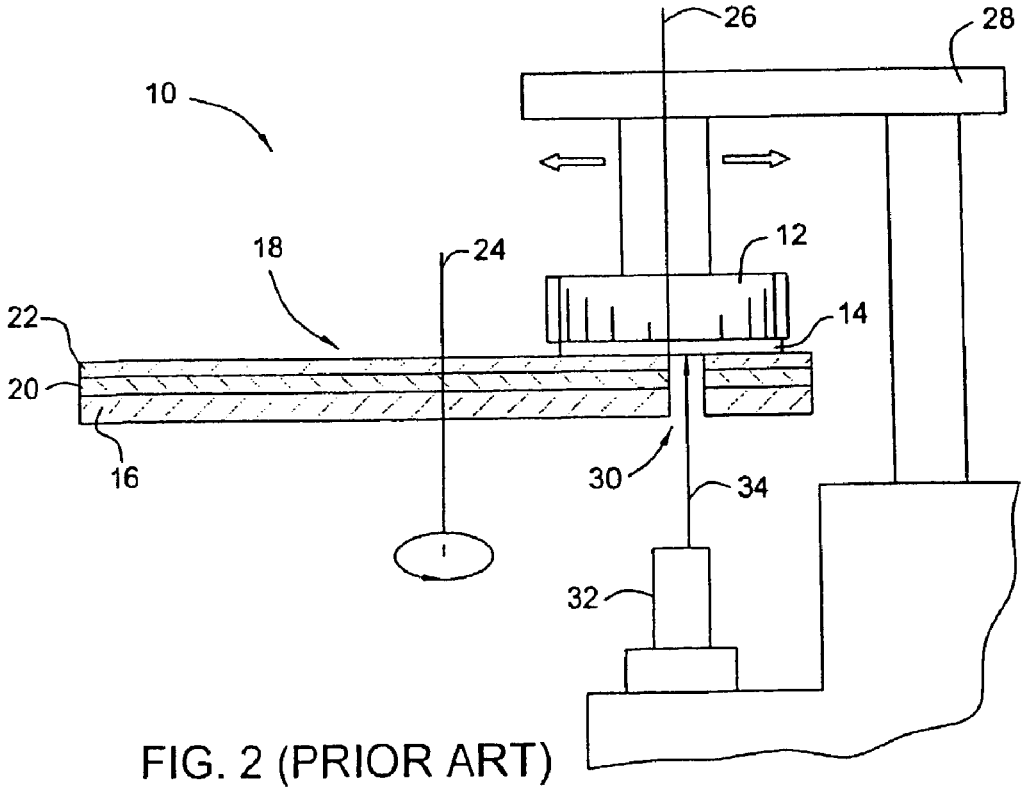
FIG. 2 (PRIOR ART)
FIG. 2 is a side view of a chemical mechanical polishing apparatus with endpoint detection constructed in accordance with the present invention.

FIG. 2 depicts a portion of a CMP apparatus modified in accordance with one embodiment of the present invention. A hole 30 is formed in the platen 16 and the overlying platen pad 18. This hole 30 is positioned such that it has a view of the wafer 14 held by a polishing head 12 during a portion of the platen's rotation, regardless of the translational position of the head 12. A laser interferometer 32 is fixed below the platen 16 in a position enabling a laser beam 34 projected by the laser interferometer 32 to pass through the hole 30 in the platen and strike the surface of the overlying wafer 14 during a time when the hole 30 is adjacent the wafer 14.

Figure 3:
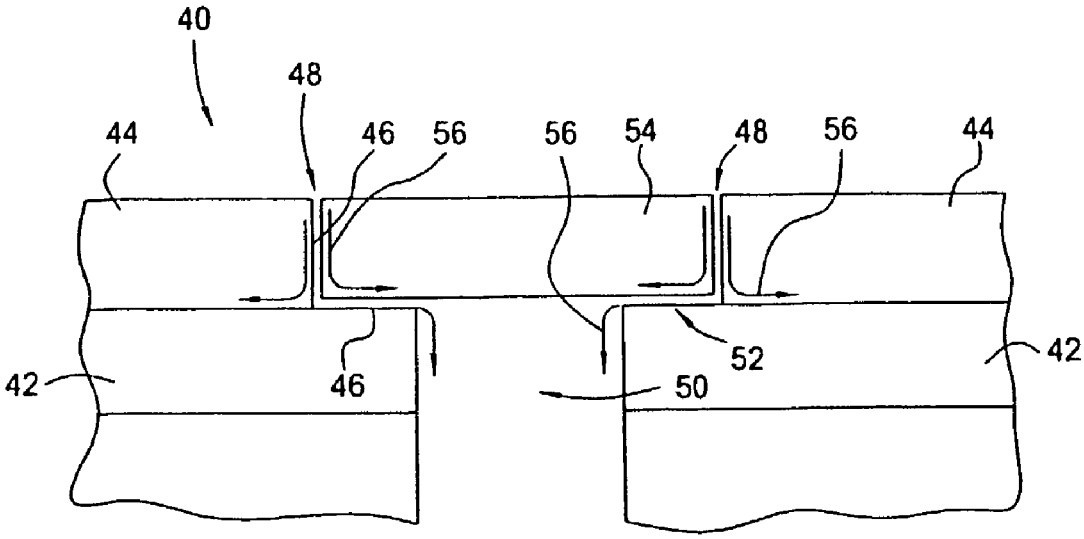
FIG. 3 (PRIOR ART)
FIG. 3 is a simplified cross-sectional view of a window portion of a polishing pad useable in the chemical mechanical polishing apparatus of FIG. 2.

A possible configuration of a window portion of a polishing pad useable with the apparatus of FIG. 2 is depicted in FIG. 3. The polishing pad 40 comprises a bottom layer 42 and a top layer 44. The bottom layer 42 may be made of a felted polyurethane, such as SUBA-IV manufactured by Rodel. The top layer 44 may comprise a blown polyurethane pad, i.e., a pad filled with micro spheres, such as the Rodel IC 1000 material. A thin layer of pressure sensitive adhesive 46 holds the top layer 44 and the bottom layer 42 together.

To assemble the polishing pad 40 depicted in FIG. 3, an intact bottom layer 42 (i.e. without an aperture formed within the layer 42) has its top surface coated with the pressure sensitive adhesive 46. An intact top layer 44 is then pressed against the bottom layer 42 and on the pressure sensitive adhesive 46. Alternatively, the top layer 44 may already include an aperture 48 prior to the top layer 44 being pressed against the pressure sensitive adhesive 46.

Following the disposing of the top layer 44 on the bottom layer 42, the aperture 50 is formed in the bottom layer 42. Formation of this aperture 50 removes the pressure sensitive adhesive 46 within the aperture 50 so that an open channel exists through the polishing pad 40. The aperture 48 in the top layer 44 is wider than the aperture 50 in the bottom layer 42. This creates a shelf 52 covered with pressure sensitive adhesive 46. A polyurethane window, forming a transparent window block 54, may be pressed against the pressure sensitive adhesive 46 on the shelf 52. The transparent window block 54 completely fills the first aperture 48 in the top layer 44. Laser light from a laser interferometer may be directed through the first aperture 50 through the transparent window block 54 seated in the aperture 48 of the top layer 44 and onto a wafer.

Although the polishing pad depicted in FIG. 3 may be used with the chemical mechanical polishing apparatus of FIG. 2, it can suffer from leakage of slurry into the aperture 50. This occurs regardless of the use of the adhesive 46, since the adhesive 46 does not extend across the first aperture 50. The flow of slurry may follow the path 56 indicated by the arrows in FIG. 3. The slurry is able to travel down a path 56 between the transparent window block 54 and the top layer 44 which is formed by a blown polyurethane and is therefore not very absorbent. The slurry continues along a path on the shelf 52 and a channel formed between the adhesive 46 and the transparent window block 54. The slurry may then escape into the aperture and soak the bottom layer 42, which is made of felted polyurethane and is therefore relatively absorbent. Due to the compressibility of the bottom layer 42 during polishing, downward pressure on the pad is exerted and released, which creates a local pumping action that increases the flow of slurry. As discussed earlier, the presence of liquid in the aperture 50 attenuates the laser light from the laser interferometer as well as scatters the laser light.

Figure 4:
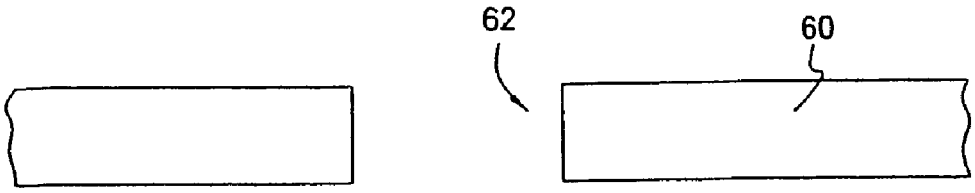
FIG. 4 is a simplified cross-sectional view of the bottom layer of a polishing pad constructed in accordance with an embodiment of the present invention after an initial stage of preparation.

The present invention overcomes some of the concerns raised by the use of a polishing pad constructed as in the embodiment of FIG. 3. FIG. 4 shows a cross-section of a bottom layer 60 of a polishing pad. The bottom layer 60 has an aperture 62 formed, for example, by cutting an aperture from a previously intact bottom layer 60. The bottom layer 60 may be a felted polyurethane, such as SUBA-IV, as typically used in the industry.

Figure 5:
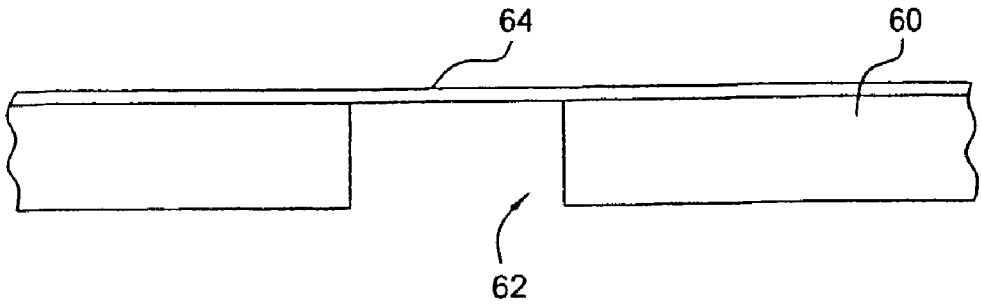
FIG. 5 is a cross-sectional view of polishing pad of FIG. 4, after a transparent sheet has been disposed on the top surface of the bottom layer, in accordance with embodiments of the present invention.

The cross-section of FIG. 5 depicts the bottom layer 60 after a transparent sheet 64 has been disposed on the top surface of the bottom layer 60. Transparent sheet 64 has a pressure-sensitive adhesive on both of its sides, such as Product No. 442 Double-Coated Tape available from 3M of St. Paul, Minn. Preferably, for example, it is preferred that the thickness of the transparent sheet 64 be approximately 0.005 inches or less. The transparent sheet 64 may cover the entire surface of the bottom layer 60 or may merely extend over the entire aperture 62 and some of the surrounding area around the aperture 62. The transparent sheet 64 is made of a material, such as polyethylene terephthalate (PET) or mylar, which is impermeable to the chemical mechanical polish slurry so that it can create a barrier to the slurry reaching the felted polyurethane of the bottom layer 60.

Figure 6:
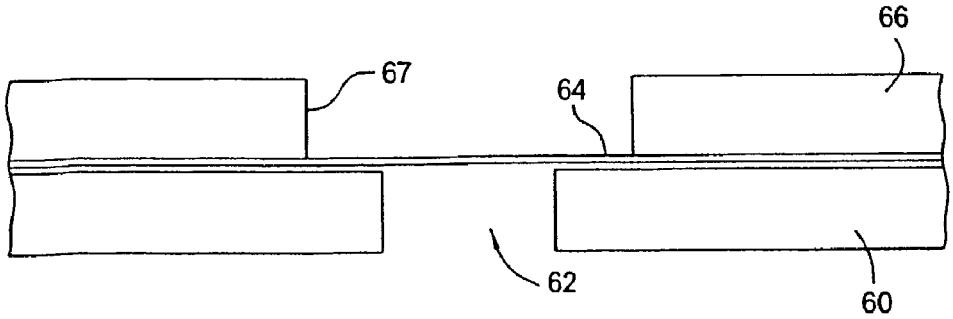
FIG. 6 is a cross-sectional view of the window of a polishing pad in accordance with an embodiment of the present invention, after a top layer of the polishing pad has been disposed over the transparent sheet.

As shown in FIG. 6, a top layer 66, comprising a blown polyurethane pad, such as Rodel IC 1000, is pressed on the adhesive on the transparent sheet 64. The top layer 66 already includes an aperture 67 formed prior to the pressing on of the top layer 66 onto the transparent sheet 64. Therefore, once the layers 60, 64, 66 are pressed together, apertures are not cut into any of the layers. This allows the transparent sheet 64 to remain intact over the aperture 62 and the bottom layer 60.

Figure 7:
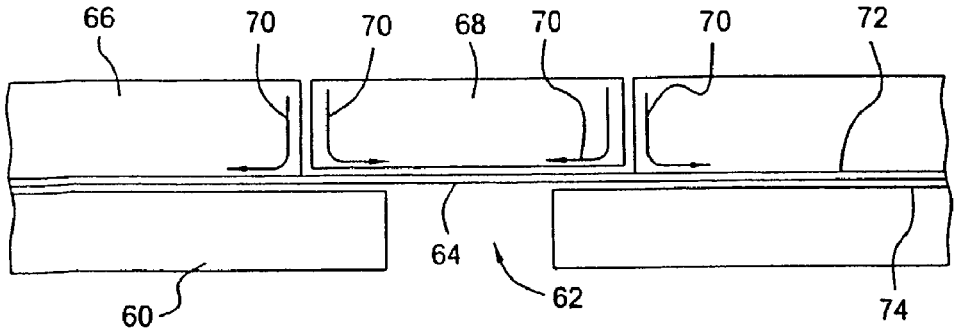
FIG. 7 is a cross-sectional view of the window apparatus of FIG. 6, following the fitting of a transparent window block in the aperture of the top layer of the polishing pad.

FIG. 7 depicts a cross-section of the polishing pad after a transparent window block 68 has been pressed into the aperture 67 of the top layer 66. The transparent window block 68 may be made of material similar to that of top layer 66 and match the parameters of top layer 66, e.g., a clear cast polyurethane, and is held in place by the adhesive on the transparent sheet 64.

The transparent sheet 64 acts as a shield against penetration of the slurry to the bottom layer 60. The path 70 taken by the slurry is only at the interface between the transparent window block 68 and the top layer 66. The slurry may travel between the first interior surface 72 of the polishing pad and the transparent sheet 64. An insignificant amount of slurry may thus be present between the transparent window block 68 and the transparent sheet 64. However, the amount of slurry that is able to enter between the transparent window block 68 and the transparent sheet 64 will not have an appreciable effect on the attenuation or scattering of the laser light from a laser interferometer. The transparent sheet 64 prevents the slurry from reaching the second interior surface 74 of the polishing pad, formed by the top surface of the bottom layer 60.

One of the concerns in forming the structure of FIG. 7 is the registration of the aperture 62 in the bottom layer 60 with the apertures 67 in the top layer 66. Because of this concern, the polishing pad depicted in FIG. 3 has its apertures 48, 50 cut out only after the bottom layer 42 and top layer 44 are pressed together. The cutting out of the apertures after the top and bottom layers 42, 44 are pressed together prevents a contiguous sheet of a barrier material, such as a transparent sheet of PET or mylar, from remaining intact within the aperture. One of the reasons for cutting the apertures after the top and bottom layers 42, 44 are pressed together is a concern with registering the top aperture 48 and the bottom aperture 50 if these apertures were cut out prior to the pressing together of the top and bottom layers 42, 44. In order to overcome this concern and allow the apertures to be cut out in the individual layers prior to pressing together the layers, thereby permitting the use of a contiguous sheet of a barrier material, the present invention provides registration indicators on the top and bottom layers 60, 66.

Figure 8A:
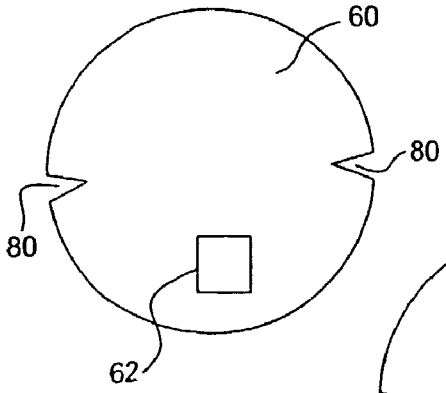
FIG. 8*a* is a top view of the bottom layer of a polishing pad in accordance with an embodiment of the present invention.
Figure 8C:
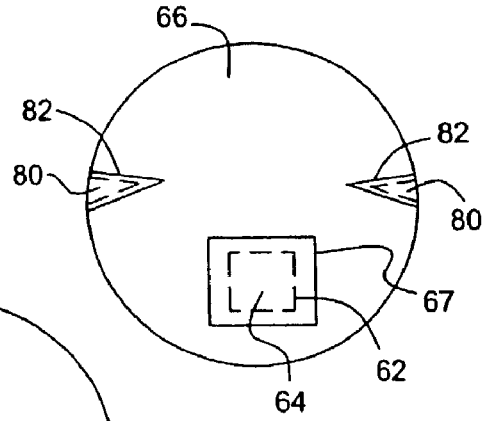
FIG. 8*c* is a top view of the polishing pad of FIG. 8*b*, after the top layer has been disposed on the transparent sheet, as depicted in the cross-section of FIG. 6.
Figure 8B:
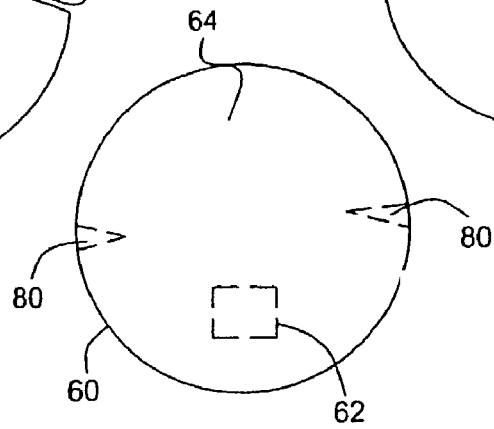
FIG. 8*b* is a top view of the polishing pad of FIG. 8*a*, after a transparent sheet has been disposed on the top surface of the bottom layer, as depicted in the cross-section of FIG. 5.

FIGS. 8*a*–8*c* depict the polishing pad of the present invention during various stages of assembly. In FIG. 8*a*, a top view of the bottom layer 60 is provided. The aperture 62 is already cut into the bottom layer 60. Registration notches 80, or some other registration mark, such as a line on the circumference of the bottom layer 60, are provided in the bottom layer 60. Registration notches 80 can be a small size (½" dice or less so as not to adversely affect polishing performance.

FIG. 8*b* depicts a top view of the polishing pad after the transparent sheet 64, such as 30 PET or mylar, has been disposed on the top surface of the bottom layer 60. The notches 80, the window 62 and the bottom layer 60 are depicted in phantom since they lie underneath the transparent sheet 64 in FIG. 8*b*.

FIG. 8*c* depicts the top view of the polishing pad after the top layer 66 has been positioned and pressed against the adhesive on the transparent sheet 64. Top layer 66 has also had its aperture 67 cut out prior to the top layer 66 being pressed against the transparent sheet 64. The top layer 66 also includes registration notches 82 or other registration marks that are aligned with the registration marks 80 of the bottom layer 60. During assembly, the registration marks 80, 82 of the layers 60, 66 are aligned prior to the pressing down of the top layer 66 against the transparent sheet 64. When the alignment marks 80, 82 are perfectly aligned, the apertures 62, 67 and layers 60, 66 will be properly registered. In the above manner, by providing for registration of the apertures during assembly of the top and bottom layers 66, 60, a contiguous barrier such as a transparent sheet of PET or mylar can be maintained in a contiguous state within the aperture and serve to prevent fluid from entering the aperture of the bottom layer 60.

The present invention provides an effective solution to the prevention of leakage in a polishing pad that is used in a chemical mechanical polishing apparatus that employs a laser interferometer to detect the conditions of the surface of a semiconductor wafer on a polishing pad. The arrangement is relatively inexpensive said improves the performance of the laser interferometric or measuring process by reducing the amount of slurry that may diffract and attenuate the laser light.

Although the present invention has been described and illustrated in detail, it is to be clearly understood that the same is by way of illustration and example only and is not to be taken by way of limitation, the scope of the present invention being limited only by the terms of the appended claims.

What is claimed is:

1. A polishing pad, comprising:

an opaque polishing layer having a polishing surface, the polishing layer having a first aperture therethrough;

a backing layer having a second aperture therethrough, the second aperture aligned with the first aperture; and a slurry-impermeable transparent sheet positioned between the polishing layer and the backing layer, the transparent sheet spanning the second aperture but extending over less than the entire backing layer.

2. The polishing pad of claim 1, further comprising a window block secured in the first aperture.

3. The polishing pad of claim 2, wherein the window block comprises polyurethane.

4. The polishing pad of claim 2, wherein the window block is secured to the transparent sheet.

5. The polishing pad of claim 4, wherein the window block is adhesively secured to the transparent sheet.

6. The polishing pad of claim 1, wherein the transparent sheet comprises polyethylene terephthalate (PET) or mylar.

7. The polishing pad of claim 1, wherein the transparent sheet extends over an area of the backing layer surrounding the second aperture.

8. The polishing pad of claim 1, wherein the first aperture is wider than the second aperture.

9. The polishing pad of claim 1, wherein the transparent sheet spans the first aperture.

10. The polishing pad of claim 1, wherein the transparent sheet contacts the polishing layer and the backing layer.

11. The polishing pad of claim 10, wherein the transparent sheet is secured to the polishing layer and the backing layer with an adhesive.

12. The polishing pad of claim 11, wherein the adhesive comprises a pressure-sensitive adhesive.

13. The polishing pad of claim 1, further comprising a first registration mark in the polishing layer and a second registration mark in the backing layer aligned with the first registration mark.

14. The polishing pad of claim 13, wherein the first registration mark comprises a notch at an edge of the polishing layer.

15. The polishing pad of claim 13, wherein the second registration mark comprises a notch at an edge of the backing layer.

16. The polishing pad of claim 13, wherein the first registration mark and the second registration mark are ½ inch or less in size.

17. The polishing pad of claim 13, wherein the polishing layer and the backing layer each have a plurality of registration marks.

* * * * *